US006305839B1

(12) United States Patent
Krstulovic

(10) Patent No.: US 6,305,839 B1
(45) Date of Patent: Oct. 23, 2001

(54) WRISTWATCH TO AID IN SMOKING CESSATION PROGRAM

(76) Inventor: Duje Krstulovic, 10144 Boca Entrada Blvd. Apt. 213, Boca Raton, FL (US) 33428

( * ) Notice: Subject to any disclaimer, the term of this patent is extended or adjusted under 35 U.S.C. 154(b) by 0 days.

(21) Appl. No.: 09/465,055

(22) Filed: Dec. 16, 1999

(51) Int. Cl.[7] ..... A44C 5/00; G04F 10/00
(52) U.S. Cl. ..... 368/281; 368/107
(58) Field of Search ..... 368/28, 281, 107, 368/89

(56) References Cited

U.S. PATENT DOCUMENTS 4,853,854 * 8/1989 Behar ..... 364/413.01
5,200,891 * 4/1993 Kehr ..... 364/413.01
5,203,472 * 4/1993 Levenbaum ..... 221/15

* cited by examiner

*Primary Examiner*—Bernard Roskoski
(74) *Attorney, Agent, or Firm*—Richard L. Huff

(57) ABSTRACT

A wristwatch to aid cigarette smokers to gradually decrease the number of cigarettes smoked per day over a period of time. The face displays an area which indicates the permissibility or lack of permissibility of smoking. A display area indicates the number of cigarettes smoked during the current day. Another display indicates the number of days the watch has been on the same smoking countdown. A fourth display indicates the time remaining in a non-smoking period. Buttons placed around the rim for the watch activate the lack of smoking display and the smoking countdown time display. Additional buttons are pressed to start the timing for the number of days the watch has been on the same smoking countdown, to increase the displayed number of days the watch has been on the same smoking countdown, to change the display showing the number of cigarettes smoked during the current day, and to change the length of time the watch will show a non-smoking display.

4 Claims, 1 Drawing Sheet

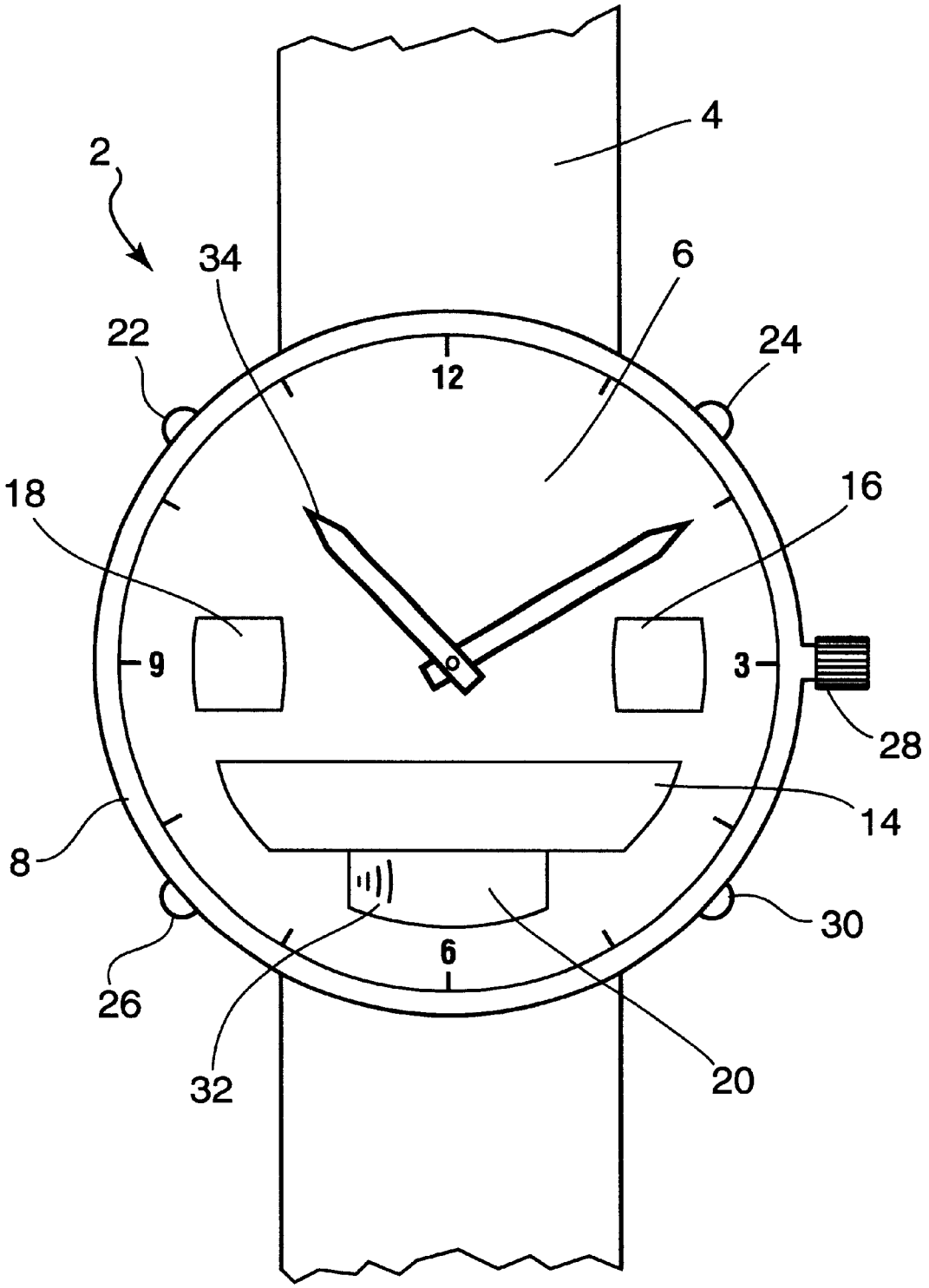
2
4
34
6
22
24
12
18
16
9
3
28
14
8
30
6
26
32
20

WRISTWATCH TO AID IN SMOKING CESSATION PROGRAM

BACKGROUND OF THE INVENTION

1. Field of the Invention

The technical field of this invention relates to a wristwatch which is to be used by a person on a smoking cessation program. The wristwatch reminds the user when it permissible to smoke or when the user should refrain from smoking according to instructions programmed into the watch.

2. Description of the Related Art

The prior art is aware of wristwatches which aid in smoking cessation programs. Thus, U.S. Pat. No. 5,285,430 to Decker discloses a wristwatch having the shape of an octagonal stop sign. This watch has the message "stop" continuously displayed on its face. Conceding that this message will not be totally effective, the watch also has three digital displays. There is a display for normal watch functions, such as time of day. There is a count-up display for displaying the time since the last cigarette. Finally, there is a display for providing a positive reinforcement message. This wristwatch offers encouragement for a person who is attempting to stop smoking "cold turkey", but is not well adapted for use in a systematic program in which the smoker gradually lengthens the time between cigarettes and is finally able to give up smoking entirely.

U.S. Pat. No. 3,777,475 to Grossan discloses a wristwatch having a manually operated counter which displays the number of cigarettes smoked during a day. The counter will provide a colored indication of when a preset limit of number of cigarettes is being approached or has been reached. However, there is no constant indication which tells the user if it is permissible to smoke or whether to refrain from smoking in order to stay on a pre-planned program.

U.S. Pat. No. 5,861,797 to Becker discloses a wristwatch to be worn by a student having Attention Deficit Hyperactivity Disorder. The display case on the watch displays normal watch functions, a notice to pay attention accompanied by a tactile reminder, and pre-programmed reminder message. While having nothing to do with pre-programmed smoking cessation programs, this patent does indicate the degree of sophistication existing in the art and offers an indication of the level of skill possessed by watchmakers.

U.S. Pat. No. 5,157,640 to Backner discloses a wristwatch which, in addition to displaying normal watch functions, emits an audible alarm and a visual message as to the type and dosage of medication to be taken when the time for taking medication has been reached.

U.S. Pat. No. 4,311,448 to Strauss discloses a cigarette lighter, matchbox, or cigarette case for use in a program designed for the cessation of cigarette smoking. In using this device, a program for the gradual lengthening of the time period between smoking is automatically established and installed into the device as a result of a preliminary testing period used to determine the smoker's rate of smoking prior to entering the program. The system of the invention includes a timer which, upon use of the device, automatically starts a new predetermined timing period during which only a single cigarette may be smoked. The device contains an indicator visible to the user to indicate when the end of the no-smoking period has been reached. The device also contains a visible count-down timer which allows the user to see how much time is left before smoking is permitted. While exhibiting many excellent features, this invention requires that the user constantly have possession of the device. User control to speed up or slow down the program is lacking. Any use of the device other than to light the cigarette of the user would take the user off the program.

U.S. Pat. No. 5,625,334 to Compton describes a safety device in a medicine container which provides an indication to a patient that medication has been taken within a prescribed time period and should not be taken again.

U.S. Pat. No. 4,862,431 to Drouin describes a cigarette case containing a timing device to aid in the withdrawal of cigarette smoking. During the user-defined period when smoking is permitted, the case emits a pleasing sound. If an attempt is made to open the case during the period when smoking is not permitted, either an irritating alarm is set off or the case will not open. The case contains a time display which indicates the time since the latest cigarette was removed. This device has the disadvantage of not allowing the user to offer someone else a cigarette. Also, there are occasions when, for acceptable reasons, the user may wish to have another smoke during the non-smoking period of the program. The device of this invention would not permit this or would permit it at the expense of listening to, and having others listen to, an irritating message.

Thus, it can be seen that, in spite of the plethora of devices directed to the admirable goal of helping a smoker quit the destructive habit and in spite of the existence in the art of the scientific means to construct a workable device for this purpose, disadvantages continue to exist in the known devices made for this purpose. The purpose of the present invention is to provide a device which will inform the user of the current status in the user-set program without revealing this status to others in the form of noises. The device of this invention relies upon the character strength and desire of the user to stop smoking, and will not physically prevent the user of the device from smoking during a no-smoking period if the occasion requires it.

SUMMARY OF THE INVENTION

There are two typical approaches to the elimination of the habit of smoking cigarettes. One such approach involves quitting "cold turkey". This approach, especially for heavy smokers, has been shown to be generally unsuccessful because of the powerful cravings for nicotine that sudden withdrawal produces. Another approach is the gradual reduction in the number of cigarettes smoked per day until the number is so few that smoker can quit entirely. Either of these approaches may make use of smoking-elimination aids, such as trans-dermal nicotine. The approach taken by the present invention is that of the gradual reduction over a sustained period of time. Also, the approach of the present invention follows the teachings of U.S. Pat. No. 3,424,123 to Giffard that there is an advantage to making cigarettes available to the smoker throughout the period of withdrawal.

To accomplish this goal, this invention discloses a wristwatch to be worn by the smoker wishing to quit smoking or to significantly lower the rate of smoking. This wristwatch is used in generally following the program set out in Table I of U.S. Pat. No. 4,311,448 to Strauss which is incorporated herein by reference.

The present invention relates to a wristwatch which aids in the elimination of nicotine addiction through the gradual reduction of the number of cigarettes smoked each day. This goal is achieved by providing a wristwatch having, in addition to the conventional analog display functions on the face of the watch, the following features:

- a display showing the number of cigarettes smoked per day, a display showing the number of days the watch has been on the same smoking countdown, a sleeping countdown button, a smoking countdown adjustment button, a smoking countdown button, a smoking permission display, and a smoking countdown time display.

The face of the watch shows conventional analogue timepiece functions, showing the hours, minutes, and seconds of the time of day. Other features, such as the date and day of the week, may be shown.

The display showing the number of cigarettes smoked during the current day gives information to the user as to how many cigarettes have been smoked that day. Each time the smoking countdown button is pressed, the number in this display is increased by one. Each time the sleeping countdown button is pressed, the number in this display returns to zero.

The display showing the number of days the watch has been on the same smoking countdown gives information as to how many days the wristwatch has been set at the same countdown time. Each time the sleeping countdown button is pressed, the number in this display is increased by one. Each time the smoking countdown adjustment button is pressed, the number on this display returns to zero.

The smoking permission display gives a non-smoking message after it has been activated and until it has been displayed for a designated length of time, at which time the display gives a permission-to-smoke message. This display is activated by pressing the smoking countdown button or sleeping countdown button.

The smoking countdown time display provides a digital indication of the time remaining in a non-smoking period. The starting time indicated by this display is responsive to the smoking countdown adjustment button and the pre-set non-smoking sleeping period built into the watch at the time of manufacture.

The sleeping countdown button starts a no-smoking indication in the smoking permission display.

The smoking countdown adjustment button adjusts the countdown time which determines the length of time that the messages indicating the lack of permission to smoke will be displayed in the smoking permission display.

As seen from the above-cited patents, those skilled in the art have the tools, technology, and know-how to make wristwatches having display areas for numbers and text which are not related to normal timepiece operations. Those skilled in the art are well able to manufacture timepieces having buttons which control countdown operations and numbers to be put in display areas. The inventor does not suggest that this invention is directed to a new advance in technology, but in a new way of applying technology which is already available to the artisan. Accordingly, the precise electrical operation of the wristwatch of the present invention will not be discussed.

BRIEF DESCRIPTION OF DRAWING

The FIGURE is a plan view of an analog wristwatch of the present invention.

DESCRIPTION OF THE PREFERRED EMBODIMENTS

With reference to the FIGURE, the invention will now be described.

The wristwatch 2 of the present invention comprises a conventional wrist band 4, a face 6 and a rim 8.

On the face 6, the time functions are shown in analog form.

The watch 2 face 6 contains digital display areas 14 16 18 20 which give information to the user. The watch rim 8 contains buttons 22 24 26 28 30 which control or alter these displays 14 16 18 20.

The watch 2 face 6 contains a smoking permission display 14 which indicates permission or lack of permission to smoke, a daily number display 16 which shows the number of cigarettes smoked that day, a progress display 18 which shows the number of days the user has been on the same smoking countdown, and a smoking countdown time display 20 which shows the time remaining in a non-smoking period.

The watch 2 rim 8 has a smoking countdown button 22, a sleeping countdown button 24, a smoking countdown adjustment button 26, a time adjustment button 28, and a noise warning on/off button 30.

The interrelationships of these displays 14 16 18 20 and buttons 22 24 26 28 30 will now be described.

SMOKING COUNTDOWN BUTTON

The rim 8 has a smoking countdown button 22 which is so connected with the daily number display 16 that each time the smoking countdown button 22 is pressed, the number in this display 16 is increased by one. Thus, each time the user finishes a cigarette, a simple press of this button 22 will keep track of the number of cigarettes smoked in the current day. The smoking countdown button 22 is pressed each time a cigarette is smoked. This button 22 is connected to the smoking permission display 14 so as to activate the display 14 to change from a smoking allowed message to a non-smoking message.

SMOKING PERMISSION DISPLAY

The face 6 of the watch 2 contains a smoking permission display 14 which indicates to the user when smoking is permitted or not permitted. This information may be in the form of a solid color, words, or a combination of colors and words. Thus, lack of permission to smoke may be indicated by a solid red display, the words, "no-smoking", or a combination of the two. Permission to smoke may be indicated by a solid green color, the words OK to smoke" or a combination of the two. Other, equivalent, messages may also be used. Upon being activated by the sleeping countdown button 24, this display 14 presents a message which indicates that no smoking is permitted. This message is displayed for a time which is pre-set at the time of manufacture, preferably eight and one-half hours.

SLEEPING COUNTDOWN BUTTON

The rim 8 also contains a sleeping countdown button 24 which is so connected with the daily number display 16 that each time the sleeping countdown button 24 is pressed, the number in this display 16 returns to zero. This button 24 also activates the smoking permission display 14 to indicate lack of permission to smoke. Additionally, this button 24 activates the smoking countdown time display 20 to indicate the time remaining before smoking is permitted, starting at the pre-set sleeping time. Pressing of this button 24 also increases the number in the progress display 18 by one.

Thus, when the user retires for the night, a simple press of the sleeping countdown button 24 will reset to zero the display 16 which indicates the number of cigarettes smoked during the current day, will increase by one the number indicated in the display 18 which indicates the number of days the watch has been on the same smoking countdown, will activate the message in the smoking permission display 14 to indicate that smoking is not permitted, and will begin a digitally displayed countdown in the smoking countdown time display 20 of the time that this message will be displayed.

SMOKING COUNTDOWN ADJUSTMENT BUTTON

The smoking countdown adjustment button 26 regulates the length of time the smoking permission display 14 will indicate a lack of permission to smoke. Also, this button 26 regulates the initial time indicated in the smoking countdown time display 20. A single press of the button 26 increases the initial time indicated in the smoking countdown time display 20 by five minutes. Thus, for small changes, the user may desire a small number of individual presses. When the button 26 is held down, the display 20 changes continuously until the button 26 is released. The minimum time which can be displayed in the smoking countdown time display 20 is five minutes. The maximum time is seven hours. When a time of seven hours is reached, further presses of the smoking countdown adjustment button 26 decrease the time at five minute intervals. Also, the time may be decreased continuously if the button 26 is held down. The smoking countdown adjustment button 26 will be used every four to seven days depending upon the user's readiness to move to another step in the program. The usual adjustment is an increase in the non-smoking period of five minutes.

DAILY NUMBER DISPLAY

On the face 6 of the watch 2, there is a daily number display 16 which displays the number of cigarettes smoked that day. The number in this display 16 increases by one each time the smoking countdown button 22 is pressed. This display 16 is reset to zero each time the sleeping countdown button 24 is pressed.

PROGRESS DISPLAY

On the face 6 of the watch 2, there is a progress display 18. This display 18 indicates the number of days the watch has been on the same smoking countdown. The sleeping countdown button 24 on the rim 8 of the watch 2 is so connected with this display 18 such that each time the sleeping countdown button 24 is pressed, the number in this display 18 is increased by one.

NOISE WARNING ON/OFF BUTTON

The user has the option of being informed audibly when the smoking permission display 14 changes from a no smoking message to a smoking permitted message. The noise warning on/off button 30 controls the status of the audible signal (not shown). Each press of the button 30 changes the status of the alarm system. Also, when the alarm system is in the active mode, a "loudspeaker" indicator 32 appears in the smoking countdown time display 20 to inform the user as to the status of the system.

SMOKING COUNTDOWN TIME DISPLAY

A smoking countdown time display 20 indicates the time remaining in a no-smoking period. The starting time is determined by pressing the smoking countdown adjustment button 26. The countdown in this display 20 is activated by pressing the smoking countdown button 22 or the sleeping countdown button 24.

TIME ADJUSTMENT BUTTON

For adjusting conventional wristwatch functions, there is a time adjustment crown 28 on the rim 8. This crown 28 operates in the known and conventional manner to set the hands 34 of the watch 2.

The use of the wristwatch 2 of this invention is simple.

At the start of the program, the user selects a length of time which will be the starting non-smoking time interval during the day, and sets the smoking countdown adjustment button 26 accordingly. This time period will be selected based on the number of cigarettes being smoked per day at the time the program is started. It is recommended that no change in the number of cigarettes smoked per day be made for the first few days while the user is adjusting to the program.

Upon arising on the day in which an adjustment to the program is to be made, the user presses the smoking countdown adjustment button 26 which will lengthen each non-smoking period by five minutes. This rate will be maintained until the user is prepared to move on to the next stage of the program.

After smoking the first cigarette, the smoking countdown button 22 is pressed. This increases the number in the display 16 showing the number of cigarettes smoked during that day from zero to one. Pressing of this button 22 also activates the smoking permission display 14 to indicate a no-smoking message and activates the smoking countdown time display 20 to show how much time is remaining in the non-smoking period.

At any time after the smoking countdown time display 20 reaches zero and a smoking permitted message appears in the smoking countdown permission display 14, the user may smoke another cigarette, pressing the smoking countdown button 22 upon extinguishing the cigarette to repeat the process.

Upon retiring for the night, the user presses the sleeping countdown button 24. This resets to zero, the display 16 indicating how many cigarettes have been smoked during the current day. This also activates the smoking permission display 14 to give a non-smoking message, and will start a digital countdown readout in the smoking countdown time display 20 showing the time remaining in the non-smoking period. This will also increase by one, the number in the display 18 which shows the number of days on the same program.

As can be seen from the above, the operation of the watch 2 of this invention is simple, and aids in the gradual reduction of smoking while remaining under the control of the user.

In addition to helping a user quit smoking, the watch 2 is designed to help cigarette smokers decrease the quantity of smoking to a lower level. The watch 2 can be used alone or in combination with other means of decreasing smoking.

With the use of the watch 2 of the present invention, the user is enabled to change from uncontrolled smoking to controlled smoking, and to decrease the level of smoking gradually over a predetermined period of time so that quitting is possible.

What is claimed is:

1. In a wristwatch for aiding in the elimination of smoking, the improvement comprising a face and a rim, I. the face comprising:

A. a smoking permission display which indicates permission to smoke or lack of permission to smoke.

B. a display showing the number of cigarettes smoked during the current day,

C. a display showing the number of days the watch has been set on the same smoking countdown, and D. a smoking countdown time display showing the time remaining in a non-smoking period, and II. the rim comprising:

A. a smoking countdown button,

B. a sleeping countdown button,

C. a smoking countdown adjustment button, and

D. a noise warning on/off button, wherein:

i) the smoking countdown button is so connected to the display showing the number of cigarettes smoked during the current day such that each time the smoking countdown button is pressed, the number in the display showing the number of cigarettes smoked during the current day is increased by one;

ii) the sleeping countdown button is so connected to the display showing the number cigarettes smoked during the current day such that each time the sleeping countdown button is pressed, the number in the display showing the number of cigarettes smoked during the current day returns to zero;

iii) the sleeping countdown button is so connected to the display showing the number of days the watch has been on the same smoking countdown such that each time the sleeping countdown button is pressed the number in the display showing the number of days the watch has been on the same smoking countdown is increased by one;

iv) the smoking countdown adjustment button is so connected to the display showing the number of days the watch has been on the same smoking countdown such that each time the smoking countdown adjustment button is pressed, the number in the display showing the number of days the watch has been in the same smoking countdown returns to zero;

v) the sleeping countdown button is so connected to the smoking permission display such that pressing the sleeping countdown button starts the countdown during the night during which lack of permission to smoke will be displayed in the smoking permission display; and vi) the smoking countdown adjustment button is so connected to the smoking permission display such that pressing the smoking countdown adjustment button adjusts the countdown time which determines the length of time the lack of permission to smoke message appears in the smoking permission display.

2. The wristwatch of claim 1, wherein the smoking permission display shows a green color to indicate permission to smoke and a red color to indicate a lack of permission to smoke.

3. The wristwatch of claim 2, wherein the smoking countdown time display contains a loudspeaker indicator which gives a visual notice when the smoking permission display changes from a no-smoking message to a permission to smoke message

4. The wristwatch of claim 1, wherein the smoking permission display shows a textual message to indicate permission to smoke or a lack of permission to smoke.

* * * * *